US005084156A

United States Patent [19]

Iwanaga et al.

[11] Patent Number: 5,084,156

[45] Date of Patent: Jan. 28, 1992

[54] ELECTROLYTIC CELL

[75] Inventors: Naruyuki Iwanaga; Tosiaki Yamaguti; Nobuhiko Fujieda; Yoshihiro Tsuzikawa; Isao Harada, all of Yamaguchi, Japan

[73] Assignee: Mitsui Toatsu Chemicals, Inc., Tokyo, Japan

[21] Appl. No.: 660,743

[22] Filed: Feb. 26, 1991

Related U.S. Application Data

[63] Continuation-in-part of Ser. No. 595,284, Oct. 10, 1990.

[30] Foreign Application Priority Data

Oct. 26, 1989 [JP] Japan ..... 1-277248
Nov. 30, 1989 [JP] Japan ..... 1-309092
Nov. 30, 1989 [JP] Japan ..... 1-309093

[51] Int. Cl.[5] ..... C25B 9/00; C25B 11/04

[52] U.S. Cl. ..... 204/243 R; 204/247; 204/292; 204/63

[58] Field of Search ..... 204/63, 243 R-247 R, 204/292

[56] References Cited

U.S. PATENT DOCUMENTS 1,113,599 10/1914 Bucher ..... 204/63 X
1,311,231 7/1919 Jacobs ..... 204/63
1,597,231 8/1926 Haynes ..... 204/247 X
2,958,634 11/1960 Cleaver ..... 204/63
3,235,474 2/1966 Tompkins, Jr. et al. ..... 204/63
4,543,242 9/1985 Aramaki et al. ..... 423/406
4,804,447 2/1989 Sartori ..... 204/63
4,933,158 6/1990 Aritsuka et al. ..... 423/210
4,975,259 12/1990 Hyakutake et al. ..... 423/406

FOREIGN PATENT DOCUMENTS 300227 of 1988 European Pat. Off. .
968142 of 1950 France .
668465 of 1952 United Kingdom .

OTHER PUBLICATIONS

Massone, J., Chemie Ingeniuer Technik, vol. 41, No. 12, (1969) pp. 695 to 700.

Patent Abstracts of Japan, vol. 14, No. 242, C-721, 4185, (May 23, 1990).

*Primary Examiner*—Donald R. Valentine
*Attorney, Agent, or Firm*—Fisher, Christen & Sabol

[57] ABSTRACT

An electrolytic cell for the production of a nitrogen trifluoride gas by a molten salt electrolysis comprises electrodes, partition plates, bottom surface, liquid surface of an electrolytic bath and lids, at least some of these members being in a particular distance relationship.

6 Claims, 3 Drawing Sheets

ELECTROLYTIC CELL

CROSS-REFERENCE TO RELATED APPLICATION

The present application is a continuation-in-part of U.S. patent application Ser. No. 595,284 filed Oct. 10, 1990.

BACKGROUND OF THE INVENTION

1. Field of the Invention

This invention relates to an electrolytic cell used for producing a nitrogen trifluoride gas by a molten salt electrolysis.

2. Description of Related Art

A nitrogen trifluoride gas is used as a dry etching agent for semiconductors and a cleaning gas for CVD apparatuses. Its demand for these uses has been recently increased. In such applications, a nitrogen trifluoride gas of high purity, in particular, the content of carbon tetrafluoride being low, should be used.

$NF_3$ gas can be manufactured by various methods. Among them, a molten salt electrolysis gives good yield and is suitable for mass production as compared with other methods and therefore, is regarded as useful commercial processes. In particular, for the purpose of producing a highly pure $NF_3$ gas containing only a small amount of $CF_4$, the molten salt electrolysis method can produce $NF_3$, at the lowest cost and thereby, the method is expected to be an advantageous method. In general, according to a process for producing $NF_3$ gas by a molten salt electrolysis, exemplary suitable molten salt baths comprise acidic ammonium fluoride, $NH_4F.HF$ systems derived from ammonium fluoride and hydrogen fluoride, or $KF.NH_4F.HF$ systems produced by adding acidic potassium fluoride or potassium fluoride or potassium fluoride to the $NH_4F.HF$ system.

However, investigations on electrolytic cells have been scarcely made upon scaling up the cells to an industrial scale in the production of $NF_3$ gas by molten salt electrolysis. In particular, nothing has been reported as to the concrete structure of such scaled-up electrodes.

When electrolytic cells are scaled up, it is advantageous to suppress the increase in the cross sectional area of the electrolytic cell as far as possible and increase the height since this results in a small floor area necessary for the electrolytic cell and, in addition, the vaporization amount of HF in a molten salt becomes relatively small.

In the process of manufacturing $NF_3$ gas, $NF_3$ gas and nitrogen ($N_2$) gas are generated at the anode while hydrogen ($H_2$) gas is generated at the cathode. That is, so-called gas generating reactions occur at the both electrodes. When $NF_3$ gas generated at anode is mixed with H, gas generated at cathode, there is a fear of explosion and therefore, it is necessary to effect a safety countermeasure so as not to cause explosion.

In order to prevent explosion, an electrolytic cell is provided with a partition plate for separating anode and cathode as illustrated in FIGS. 1 and 2.

In such an electrolytic cell having a partition plate, a current hardly flows from an anode to a cathode at a region where the partition plate separates an anode and a cathode, but can flow only at a region situated lower than the lower end of the partition plate.

For the purpose of inhibiting corrosion of the partition an electrode, it is usually preferable to use a fluororesin as the partition plate or to cover the partition plate with a fluororesin.

When a partition plate is made of or covered with a fluororesin, a current does not flow at all from an anode to a cathode at a region where both electrodes are separated by such a partition plate.

As a material for anode, a carbon (C) or nickel (Ni) electrode can be used, and a nickel electrode is preferably uses as an anode so as to obtain a highly pure gas containing less amount of $CF_4$. However, when a nickel electrode is used, there is a drawback that nickel is slightly dissolved.

The present inventors used a nickel anode for a long time. A part of the dissolved nickel precipitated on the cathode, and while the electrolysis was carried out for a long period of time, the distance between the cathode and the partition plate gradually became small.

As a result, when the distance between the cathode and the partition plate is too small, $H_2$ gas generated at cathode and $NF_3$ gas generated at anode are mixed and there is a fear that a gas mixture within explosion limits is formed.

When bubbles of $NF_3$ gas generated at the Ni electrode ware observed, it was found that many small bubbles were formed, and therefore, the bubbles could not rise directly upward along the electrode, but diffused obliquely upward.

The present inventors used the electrodes for a long period of time and found that the anode was getting shorter with the lapse of time and the current density at anode increased. As a result, the amount of $NF_3$ gas generated per unit area of the Ni anode increased and the diffusion of the $NF_3$ gas became more vigorous. As $NF_3$ gas diffused more vigorously, $NF_3$ gas generated at anode and $H_2$ gas generated at cathode were mixed when the distance between the partition plate and the anode was too small, and as mentioned above, there was a fear that a gas mixture within the explosion limits was formed in the cathode region.

As mentioned above, in the case of the production of $NF_3$ gas according to a method of a molten salt electrolysis, the distance between a partition plate separating an anode and a cathode and the anode and the distance between the partition plate and the cathode are very important from the standpoint of safety. However, investigation as the structure of electrolytic cell has not been substantially made, and in particular, there is not reported any concrete structure and configuration of electrodes and partition plates.

Further, when Ni electrodes are used, there is a disadvantage that the nickel is slightly dissolved in a electrolytic bath. When the present inventors used nickel electrodes for a long time, a part of the dissolved nickel deposited in the form of nickel fluoride at the bottom of an electrolytic cell, and while the electrolysis was carried out for a long period of time, the deposit piled on the bottom surface of the electrolytic cell. It was found that as the nickel fluoride deposited on the bottom surface of the electrolytic cell, the distance between the lower end of the electrode plate and the piled matter became small.

Therefore, when the distance between the lower end of electrode and the bottom surface of the electrolytic cell is too small, the lower end of an electrode which is nearer to the bottom surface than the other electrode begins first to be gradually buried in the nickel fluoride, and the portion of the electrode thus buried can not function as an electrode any more. As a result, the area of the electrode capable of functioning as an electrode is decreased and the current density increases resulting in rise of the voltage of electrolytic cell and poor yield. Consequently the short distance between the lower end of electrode and the bottom surface is not desirable.

In addition, when the depositing of the dissolved nickel proceeds further and both electrodes are buried in the deposit resulting in short circuit. Thus, in an extreme case, such a situation is very dangerous and explosion and a fire are caused.

It has been found that the distance between the lower end of electrode and the bottom surface of the electrolytic cell is an important problem concerning safety upon using electrolytic cells for a long period of time.

Further, the convection in an electrolytic bath in an electrolytic cell has been now found the be such that in an electrolytic bath a flow from the lower part to the upper part occurs at a region where gases near electrodes rise due to gases generated at both electrodes while the portion of the electrolytic bath having risen to the upper part reversely flows downward at a region apart from the electrodes, and this convection serves to remove Joulean heat generated between the two electrodes by electrolysis by external or internal cooling and thereby the temperature distribution in the electrolytic bath in the electrolytic cell can be kept substantially uniform.

Therefore, when the distance between the lower end of electrode and the bottom surface is to large, a convention due to gas generation is not caused in the portion of electrolytic bath near the bottom of the electrolytic cell because said portion is far from the lower end of electrode and neither is generated Joulean heat, and therefore, on the contrary, the temperature of the portion of electrolytic bath near the bottom surface is lowered too much resulting in change of the bath composition, and in an extreme case, there is a fear that said portion solidifies. Therefore, it is necessary to cool the portion of electrolytic bath near the upper part of the electrolytic cell while the lower part of the cell should be heated. It is a big problem that such complicated operation is required.

As mentioned above, upon producing $NF_3$ gas according to a molten salt electrolysis, the distance between the lower end of each of anode and cathode and the bottom surface of the electrolytic cell has now been found very important for a stable operation. However, there has not been substantially made any investigation as to the structure of electrolytic cell and, in particular, there is not any report on the distance between the lower end of electrode and the bottom surface of the electrolytic cell.

Furthermore, the temperature of molten salt upon electrolysis according to a method of a molten salt electrolysis is most preferably 100°-130° C. since the operation is easy, the electroconductivity is good and, in addition, the electric current efficiency is excellent.

However, when the temperature of the molten slat is 100°-130° C. in the $NH_4F$-HF system, the $NH_4F.HF$ (melting point of 126° C.) evaporated due to the vapor pressure disadvantageously deposits at a portion where the temperature is lower than the electrolytic bath.

When the present inventors carried out a continuous electrolysis for a long period of time, it was observed that a part of the $NH_4F$-HF system evaporated deposited on a lid of the electrolytic cell and outlets for generated gases as $NH_4F.HF$, and the gas outlets were easily clogged.

Thus, the present inventors tried to use the electrolytic cell continuously for a long period of time while flowing a carrier gas so as to prevent clog of gas outlets, but it was found that $NH_4F.HF$ deposited even on the inlet of the carrier gas and the inlet was also clogged. When carrier gas inlets and generated gas outlets are clogged as mentioned above, a pressure difference is formed between the anode chamber enclosed with partition plates and containing the gas generated at anode, $NF_3$, and the cathode chamber enclosed with partition plates and containing the gas generated at cathode, $H_2$, and thereby a liquid surface level difference is formed resulting in a cause of big trouble.

For example, when the outlet for the gas generated at anode is clogged, $NF_3$ gas can not be exhausted from the anode chamber and the generation of $NF_3$ gas continues and thereby the pressure in the anode chamber rises. As a result, the liquid surface in the anode chamber is pushed down while the liquid surface in the cathode chamber is pushed up. When the liquid surface in the anode chamber is pushed down to a level lower than the lower end of the partition plate, $NF_3$ gas in the anode chamber enters the cathode chamber to form a gas mixture within explosion limits and thereby the gas mixture is liable to explode in the cathode chamber.

Once explosion occurs, a part of an electrolytic cell is destroyed and, in addition, hydrofluoric acid, a very corrosive chemical, is released and therefore, this probably results in a serious accident, and production of $NF_3$ will be not possible any more.

When an outlet for the gas generated at anode is clogged in the anode chamber, a big accident as mentioned above occurs. When the clogging occurs in the cathode, the same accident also occurs. Therefore, clog of gas inlet and outlet is to be essentially avoided from the standpoint of safety.

However, these problems are not yet known well and any effective countermeasures have not yet been proposed.

In the molten salt electrolysis, $NF_3$ gas and $H_2$ gas generated at the electrodes rise along the respective electrodes in the electrolytic bath. Large amounts of the gases rising in the electrolytic bath are present at the upper part of the electrolytic bath and the current is interrupted by the gases so that the current flows with difficulty. As a result, there is formed a distribution of electric current density in the vertical direction of the electrodes such that the density is smaller at the upper part of the electrodes and larger at the lower part thereof. In an extreme case, electrolysis scarcely proceeds at the upper portion of the electrode (in the region situated lower than the partition plate).

In view of the foregoing, the above-mentioned method for scaling up the electrolytic cell comprising limiting the cross sectional area of the electrolytic cell as far as possible so as to reduce the floor area of the electrolytic cell and increasing the height can be used only in a limited range since the length of the electrode increases in the vertical direction correspondingly and the distribution of electric current density in the vertical direction becomes largely nonuniform and the electric current efficiency (the ratio of the electric power consumed for producing $NF_3$ to the amount of electric power applied) is lowered.

Furthermore, when the vertical length of electrode is large, the distance between the lower end of the electrode and the partition plate is also automatically long, and therefore, the amount of diffusion of the gas generated by electrolysis increases correspondingly, and $NF_3$ gas and $H_2$ gas are easily mixed disadvantageously resulting in possible explosion.

In the mean time, when the raw material, molten salt, contains water in the production of $NF_3$ gas by a molten salt electrolysis, it appears that the resulting fluorine reacts with water to form $OF_2$ gas and $H_2$ gas.

According to a literature, J. Massome, Chem. Ing. Techn., 41, 695 (1969), the mechanism for forming $NF_3$ gas by molten salt electrolysis is as shown below. That is, fluorine formed at an anode according to the following formula 1) reacts with ammonium ions in a molten salt, and according to the following formula 2) $NF_3$ gas is generated at the anode while $H_2$ gas is generated at the cathode.

$$6F^- \rightarrow 6F + 6e^- \quad 1)$$

$$6F + NH_4^+ \rightarrow NF_3\uparrow + 4H^{30} + 3F^- \quad 2)$$

However, according to the knowledge of the inventors, it is considered that when water is present in the molten salt, $OF_2$ gas and $H_2$ gas are formed according to the following formulas 3) and 4). And the resulting $OF_2$ gas and $H_2$ gas are contained in the generated $NF_3$ gas.

$$2F + H_2O \rightarrow OF_2 + 2H^+ \quad 3)$$

$$2F + H_2O \rightarrow OF_2 + H_2\uparrow \quad 4)$$

The presumed reactions in formulas 3) and 4) above can be supported by the fact that the concentrations of both $OF_2$ and $H_2$ in a gas generated at an anode become low as the electrolysis time becomes long. When $OF_2$ and $H_2$ are mixed in the gas generated at an anode, there is a danger of explosion so that it is extremely undesirable.

However, $NH_4F.HF$ molten salt is so hygroscopic that it is liable to absorb moisture in air at the stage of preparing the raw material. Therefore, for preparing $NF_3$, a dehydration electrolysis is indispensable which is effected by flowing a current at a current density lower than that at a main electrolysis, and after completion of the dehydration electrolysis, a main electrolysis is subsequently carried out.

However, in this dehydration electrolysis there occur not only generation of $NF_3$ gas at an anode by the above-mentioned reactions of formula 1) and formula 2), but also the reactions of formula 3) and formula 4). Therefore, there is a danger of explosion as well as mixing of $H_2$ gas generated at a cathode with a gas generated at an anode due to the diffusion of $H_2$ when an electrode is longitudinally long. The water content in the molten salt upon the dehydration electrolysis is rather more than that upon the main electrolysis so that possibility of explosion is stronger.

The above-mentioned electric current efficiency is usually 60–70% in the production of $NF_3$ gas according to a molten salt electrolysis.

SUMMARY OF THE INVENTION

It is an object of the present invention to provide an electrolytic cell for the production of a nitrogen trifluoride gas which is free from explosion.

According to the present invention, there is provided an electrolytic cell or the production of nitrogen trifluoride gas by a molten salt electrolysis which comprises electrodes, partition plates, bottom surface, liquid surface of an electrolytic bath and lids, at least some of these members being in a particular distance relationship.

DESCRIPTION OF THE PREFERRED EMBODIMENTS

According to one aspect of the present invention, there is provided an electrolytic cell for producing a nitrogen trifluoride gas by a molten salt electrolysis which comprises an anode, a cathode and a partition plate separating the anode and the cathode, the distance between the anode and the partition plate and the distance between the cathode and the partition plate being in the range of 30 to 200 mm.

The present inventors did a research on the distance between an anode or a cathode and a partition plate separating the anode and the cathode in an electrolytic cell for producing $NF_3$ by a molten salt electrolysis, and have found that $NF_3$ gas can be safely produced for a long period of time by limiting the distance to a certain definite range as mentioned above and have completed the present invention.

The present invention will be explained in the following by referring to the attached drawing. The most important point in this aspect is the distance between an anode or a cathode and a partition plate separating the anode and the cathode in an electrolytic cell for safely producing $NF_3$ for a long period of time.

Figure 1:
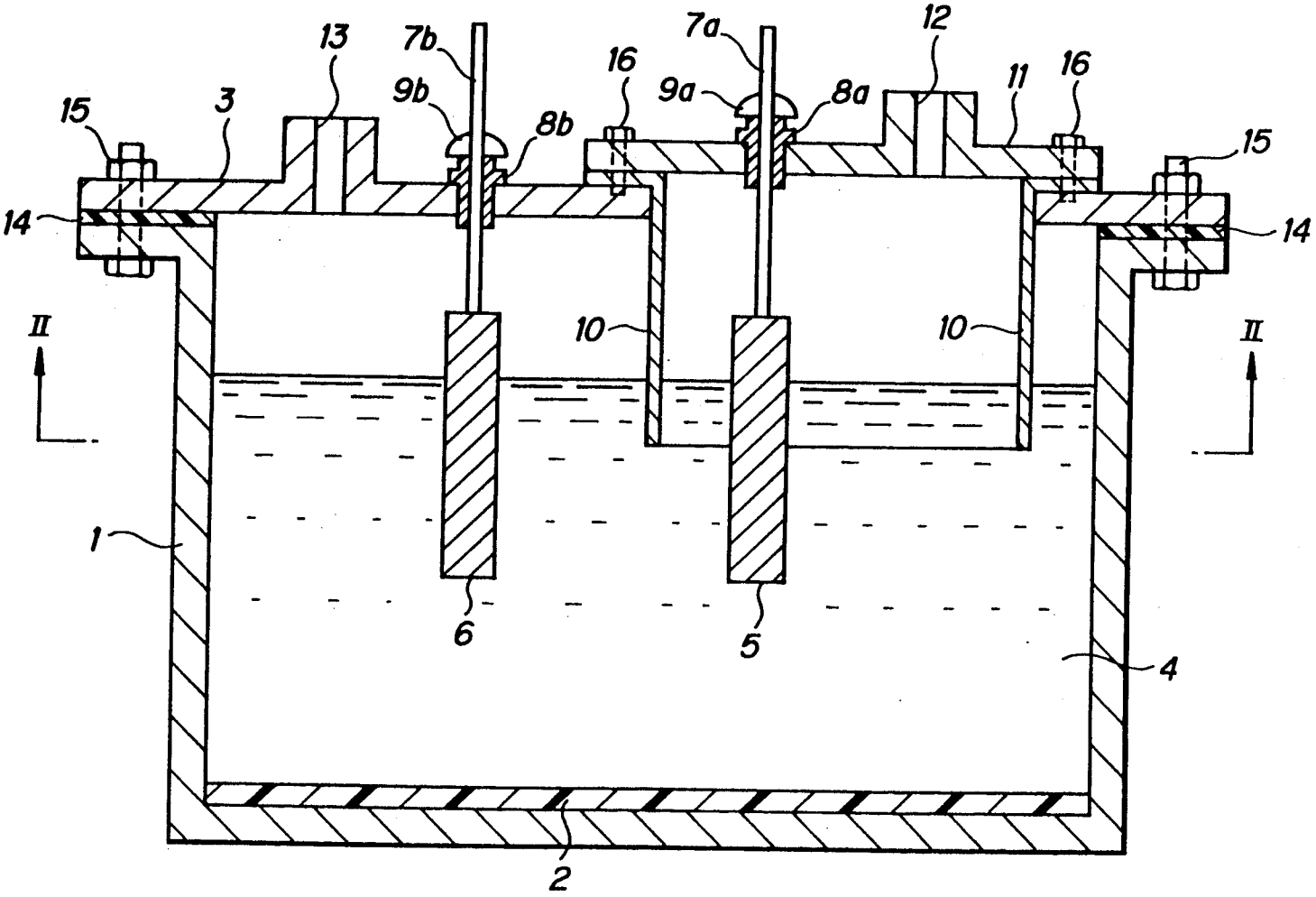
FIG. 1 is a vertical cross-sectional view of an embodiment of an electrolytic cell for producing $NF_3$ gas of the present invention.

In FIG. 1, electrolytic cell main body 1 is provided with lid 3 (hereinafter, lid 3 of the electrolytic cell comprises lid 11 for fixing a partition plate) which is fixed to the main body 1 through packing 14 by bolt and nut 15 for a lid. Lid 11 for fixing a partition plate to which partition plate 10 is fixed to lid 3 by means bolt 16 for fixing partition plate. Anode 5 has connecting rod **7*a* which is through insulating material 8*a* fitted to lid 11 for fixing partition plate and is fastened by cap nut 9*a*** for fastening a connecting rod.

Cathode 6 is also connected with connecting rod **7*b* which is through insulating material 8*b* fitted to lid 3 and is fastened by cap nut 9*b*** for fixing a connecting rod.

At the inner bottom surface of electrolytic cell main body 1 is provided fluororesin plate 2, and electrolytic bath 4 is contained in the electrolytic cell.

The anode chamber is provided with outlet pipe 12 for a gas generated at anode while the cathode chamber is provided with outlet pipe 13 for a gas generated at cathode.

Figure 2:
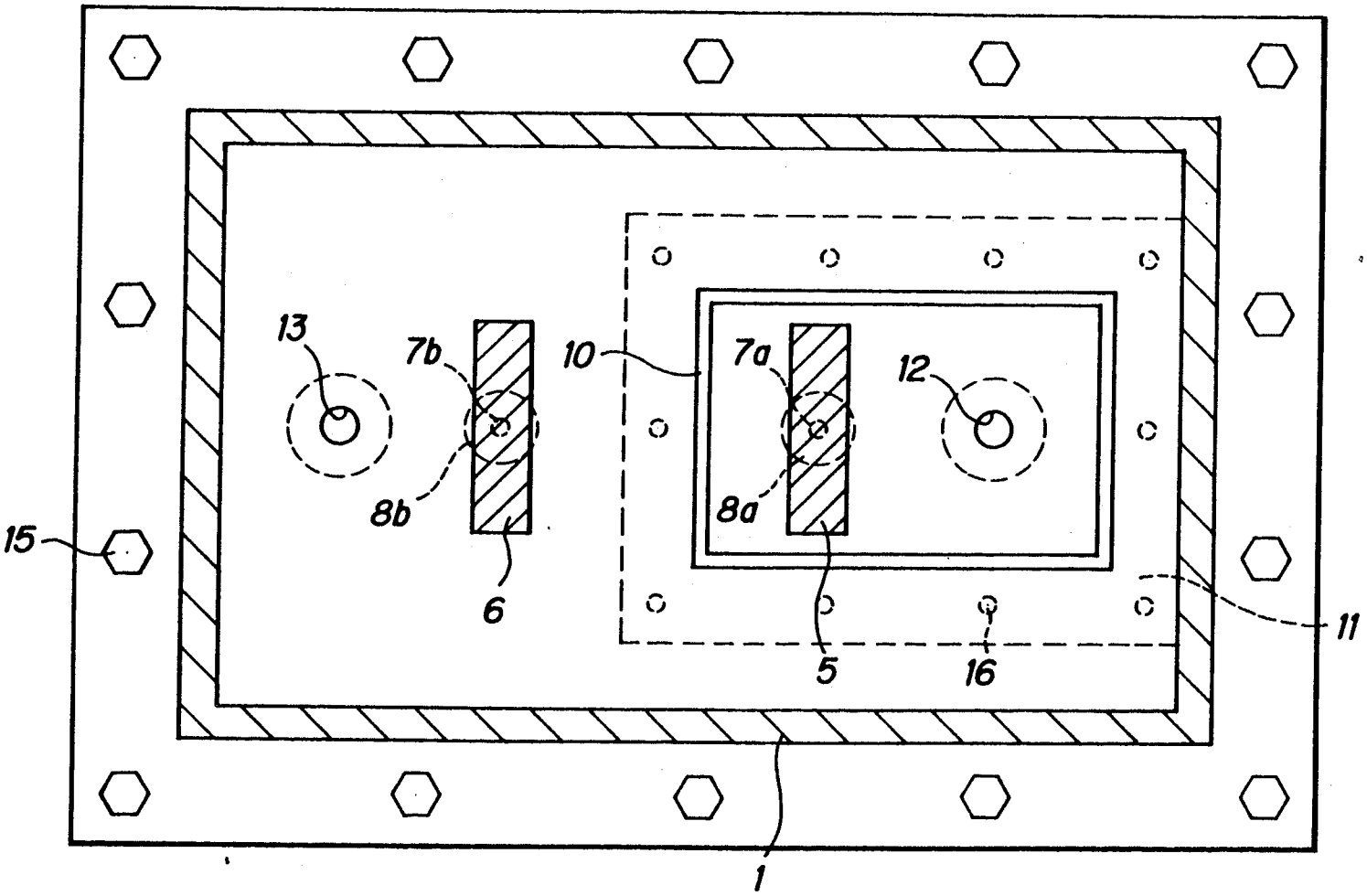
FIG. 2 is a cross-sectional view taken along line II—II of FIG. 1 and FIG. 3.

In FIG. 2, reference numbers similar to those in FIG. 1 indicate the parts similar to those in FIG. 1. The distance between anode 5 or cathode 6 and partition plate 10 is respectively 30–200 mm, preferably 30–100 mm.

When the distance between cathode 6 and partition plate 10 is less than 30 mm, a nickel electrode used as an anode is dissolved in the electrolytic bath during the operation for a long period of time and a part of the dissolved nickel deposits on the cathode (e.g. Ni electrode) to grow in the form of protrusion, and thereby the distance between cathode 6 and partition plate 10 is getting shorter.

As a result, $H_2$ gas generated at cathode 6 passes under partition plate 10 and enters the anode chamber, and thereby is mixed with $NF_3$ gas generated at anode 5 resulting in a big problem, that is, the formation of a gas mixture within explosion limits in the anode chamber.

When the distance between cathode 6 and partition plate 10 is longer than 200 mm, the size of the electrolytic cell also becomes larger accordingly resulting in an excess investment. In addition, the electrolytic bath is so hygroscopic that it inevitably absorbs moisture in air at the stage of preparing the starting materials. Therefore, upon producing $NF_3$, a dehydration electrolysis is essential which is effected by applying an electric current having a current density lower than that upon a main electrolysis, and after completion of dehydration electrolysis, the main electrolysis starts continuously. Therefore, if the size of electrolytic cell is too large, the dehydration electrolysis takes a long time and the efficiency decreases disadvantageously.

On the other hand, when the distance between anode 5 and partition plate 10 is less than 30 mm, a lot of fine bubbles of $NF_3$ gas generated at Ni anode 5 diffuse obliquely upwards and thereby, pass under the lower end of the partition plate to enter the cathode chamber and is mixed with a hydrogen gas generated at cathode to form a gas mixture within the explosion limits in the cathode chamber. This is a big problem.

When the distance between anode 5 and partition plate 10 is more than 200 mm, the resulting large size of electrolytic cell is a disadvantageous excess investment and the dehydration electrolysis takes a long time resulting in poor efficiency.

In an electrolytic cell for producing $NF_3$ gas by a molten salt electrolysis, usually a fluororesion plate is placed on the bottom plate of the electrolytic cell main body so as to inhibit corrosion.

Also in the electrolytic cell of the present invention, fluororesin plate 2 is provided as shown in FIG. 1. In addition, for purposes of preventing corrosion of the electrolytic cell, it is preferable that a fluororesion is applied to parts contacting with molten salt and gases generated by electrolysis as well as the bottom plate part (by lining or coating) in the electrolytic cell.

As fluororesins, there may be used usually known ones. Exemplary suitable fluororesins include polytetrafluoroethylene, polychlorotrifluoroethylene, polyvinylidene fluoride, polyvinyl fluoride, tetrafluoroethylene-hexafluoropropylene copolymers, tetrafluoroethylene-ethylene copolymers, tetrafluoroethylene-perfluoroalkylvinyl ether copolymers, and chlorotrifluoroethylene-ethylene copolymers.

Among them, polytetrafluoroethylene and tetrafluoroethylene-perfluoroalkyl vinyl ether copolymers are particularly preferable because of the heat resistance and acid resistance.

As explained above, the first aspect of the present invention gives a desirable distance between the anode or the cathode and the partition plate separating the anode and the cathode in an electrolytic cell for producing $NF_3$. As a result, $NF_3$ gas can be safely produced continuously for a long period of time on an industrial scale.

According to the second aspect of the present invention, there is provided an electrolytic cell for producing a nitrogen trifluoride gas by a molten salt electrolysis which comprises an electrolytic bath composed of a molten salt, an anode and a cathode soaked in the electrolytic bath such that the anode and the cathode are set substantially perpendicular to the bottom surface of the electrolytic cell, the distance between the lower end of the anode and the bottom surface and that between the lower end of the cathode and the bottom surface are in the range of 30 to 300 mm.

The present inventors have carried out researches on the distance between the lower end of each of the anode and the cathode and the bottom surface of the electrolytic cell and have found that $NF_3$ gas can be safely produced for a long period of time by selecting the above-mentioned range of the distance. Thus the present invention has been completed.

In the molten salt electrolysis for producing $NF_3$ gas, exemplary suitable molten salt baths comprise acidic ammonium fluoride, $NH_4F.HF$ systems derived from ammonium fluoride and hydrogen fluoride, or $KF.NH_4F.HF$ systems produced by adding acidic potassium fluoride or potassium fluoride to the $NH_4F.HF$ system.

The distance between the bottom surface and the lower end of each of the electrodes in 30–300 mm, preferably 50–200 mm.

The invention will be explained more in detail below referring to the drawings.

Figure 3:
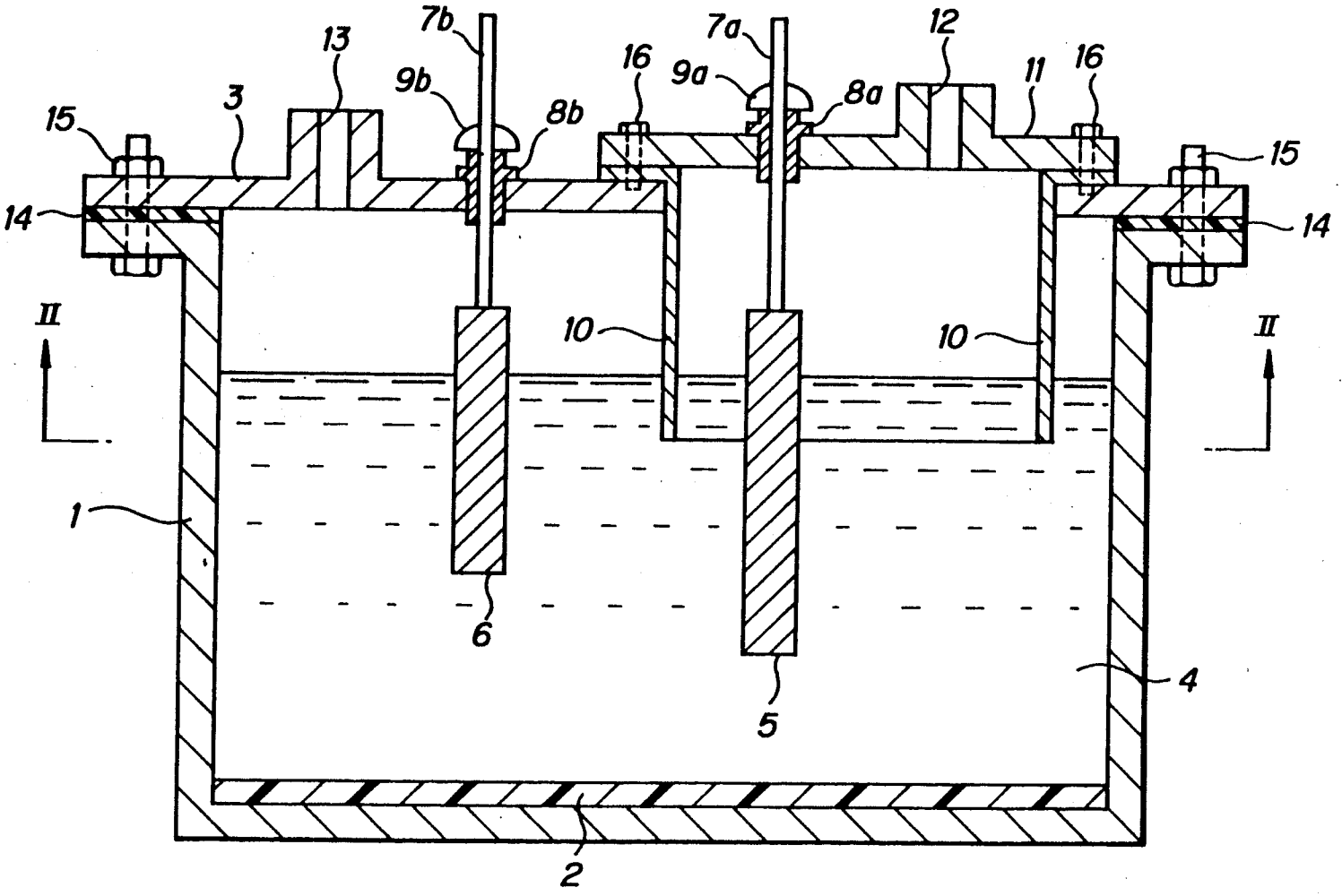
FIG. 3 is a vertical cross-sectional view of another embodiment of an electrolytic cell for producing $NF_3$ gas of the present invention.

FIG. 3 is a vertical cross-sectional view of an electrolytic cell for producing $NF_3$ gas suitable for making the present invention. The cross-sectional view taken along line II—II of FIG. 3 is the same as FIG. 2.

In FIG. 1 and FIG. 3, like reference numerals refer to like parts.

In an electrolytic cell for producing $NF_3$ gas by a molten salt electrolysis, usually a fluororesin plate is placed on the bottom plate of the electrolytic cell main body so as to inhibit corrosion of the bottom plate portion.

Also in the electrolytic cell of the present invention fluororesin plate 2 is provided as shown in FIG. 3. Therefore, in this case, the bottom surface means the liquid contacting interface between the upper surface of the fluororesin plate and the electrolytic bath. The thickness of the fluororesin plate is not critical, but is usually 1–20 mm.

For the purpose of preventing corrosion of the electrolytic cell, it is preferable to apply a fluororesin to parts contacting a molten salt and gases generated by electrolysis as well as the bottom plate part in the electrolytic cell (by lining or coating).

Therefore, what is meant by the "bottom surface of the electrolytic cell" is a liquid contacting interface between the upper surface of the fluororesin plate and the electrolytic bath when such a corrosion inhibiting material for the bottom plate is provided, but is a liquid contacting interface between the inner upper surface of the bottom plate of the electrolytic cell and the electrolytic bath when such a material as above is not present on the bottom plate.

In each case, the present invention can be effectively made. Therefore, in the following the explanation will be given referring to FIG. 3 where fluororesin plate 2 is provided.

As fluororesins, those enumerated in the first aspect of the invention can be used.

As mentioned above, the bottom surface of electrolytic cell in FIG. 3 is the liquid contacting interface between the upper surface of fluororesin 2 and electrolytic bath 4.

The lengths of an anode and a cathode are not critical. That is, one may be longer than the other and both may be the same length. In the following, the explanation will be made referring to a case where the anode is longer than the cathode, but the situation is also the same in a case where the cathode is longer than the anode.

According to the present invention, the distance between the lower end of anode 5 and the bottom surface of the electrolytic cell is 30–300 mm, preferably 50–200 mm.

When the distance between the lower end of anode 5 and the bottom surface of electrolytic cell (fluororesin plate 2) is less than 30 mm, upon using for a long period of time, a part of nickel dissolved in the electrolytic bath resulting from dissolution of Ni electrode of the anode deposits on the bottom surface in the form of nickel fluoride. As the lapse of time, the deposition increases and the distance between the lower end of the anode and the deposition decreases and finally the lower end of the anode is buried in the nickel deposition.

The portion buried in the deposition can not function any more as electrode so that the area acting as electrode decreases, and thereby the electric current density increases and the voltage in the electrolytic cell rises, and further, the yield (electric current efficiency for producing $NF_3$) is lowered.

These results cause high cost so that much attention should be paid to. In addition, when the deposit increases and both electrodes are buried in the deposit resulting from the dissolved Ni, a short circuit occurs and in an extreme case, explosion and a fire are caused. This should be absolutely avoided because of a big problem from the standpoints of safety.

On the other hand, when the distance between the lower end of anode 5 and the bottom surface of the electrolytic surface (fluororesin plate 2) is more than 300 mm, the portion of electrolytic bath near the bottom of the electrolytic cell is far from electrode so that a convection due to $NF_3$ gas generation does not occur, neither is generated Joulean heat. Therefore, on the contrary, the temperature is lowered too much and the temperature necessary for electrolysis can not be kept. Further, the bath composition is also changed, and in an extreme case, there is a fear that said portion solidifies. Therefore, it is necessary to cool the portion of electrolytic bath near the upper part of the electrolytic cell while the lower part of the cell should be heated. As a result, the procedure becomes complicated and the practical operation becomes troublesome. This is a serious problem in a practical operation and should be absolutely avoided.

In addition, when the distance between the lower end of anode 5 and the bottom surface portion of electrolytic cell (fluororesin plate 2) is more than 300 mm, the electrolytic cell gets larger accordingly resulting in an excess investment.

Further the electrolytic bath is so hygroscopic that it inevitably absorbs moisture in air at the stage of preparing the starting materials. Therefore, upon producing $NF_3$, dehydration electrolysis is essential which is effected by applying an electric current having a current density lower than that upon a main electrolysis, and after completion of dehydration electrolysis, the main electrolysis starts continuously. Therefore, as the size of the electrolytic cell increases, the time for the dehydration electrolysis becomes longer, and the efficiency decreases disadvantageously.

As mentioned above, according to the second aspect of the invention the distance between the lower end of the electrode and the bottom surface of the electrolytic cell is particularly specified as mentioned above. By selecting the particular distance, it can be avoided that the dissolved nickel form an electrode deposits on the bottom surface of the electrolytic cell and an electrode is buried in the deposit as the lapse of time and finally the electrode can not function as electrode.

As a result, neither explosion nor a fire due to short circuit of Ni electrodes occurs and therefore, $NF_3$ gas can be safely produced for a long period of time, and this significantly contributes to industrial production of $NF_3$ gas.

According to the third aspect of the present invention, there is provided an electrolytic cell for producing a nitrogen trifluoride gas by molten salt electrolysis which comprises an electrolytic bath composed of a molten salt, anode and a cathode soaked in the electrolytic bath, and a lid fitted to the electrolytic cell for preventing evaporation of the electrolytic bath, the distance between the lid and the liquid surface of the electrolytic bath being in the range of 100 to 500 mm.

The present inventors carried out researches on clogging of inlets and outlets of gases caused by evaporation of $NH_4F.HF$ in an electrolytic cell for producing $NF_3$ according to a method of a molten salt electrolysis, and have found that clogging can be prevented by setting a particular numerical range of distance between the lid of the electrolytic cell and the liquid surface of the electrolytic bath and $NF_3$ gas can be produced safely for a long period of time. Thus the present invention has been completed.

In the molten salt electrolysis for producing $NF_3$ gas, there is usually used acidic ammonium fluoride, $NH_4F.HF$ system derived from ammonium fluoride and hydrogen fluoride, or $KF.NH_4F.HF$ systems produced by adding acidic potassium fluoride or potassium fluoride to the NH F.HF system.

The invention is explained below referring to FIG. 1 AND FIG. 2 which are also used for the explanation of the first aspect.

According to the present invention, the distance between lid 3 of the electrolytic cell (hereinafter, lid 3 includes lid 11 for fixing partition plates) and the liquid surface of electrolytic bath 4 is 100–500 mm.

Electrolytic bath 4 may be a molten salt of a $NH_4F.HF$ system or $KF.NH_4F.HF$ system and electrolysis is carried out at a temperature of electrolytic bath of 100°–130° C.

$NF_3$ gas is generated at anode 5 and exhausted through anode gas outlet 12 while $H_2$ generated at cathode 6 is exhausted through cathode gas outlet 13.

In the following, the explanation will be made referring to the above-mentioned situation, but inlets for $N_2$ gas may be provided when an inert gas such as $N_2$ gas is introduced into the electrolytic cell so as to help the gases generated at both electrodes flow and in such a case following is also applicable.

The distance between lid 3 of the electrolytic cell and the liquid surface of electrolytic bath 4 is as mentioned above.

When the distance of lid 3 and the liquid surface of electrolytic bath 4 is less than 100 mm, a part of the electrolytic bath is evaporated and $NH_4F.HF$ deposits at cathode gas outlet 13 and anode gas outlet 12, and clogging occurs if the electrolytic cell is used for a long period of time.

For example, when cathode gas outlet 13 is clogged, $H_2$ gas can not be exhausted from the cathode chamber, but $H_2$ gas is continuously generated so that the pressure in the cathode chamber rises and the liquid surface in the cathode chamber is pushed down while the liquid surface in the anode chamber is pushed up.

When the liquid surface level in the cathode chamber is lowered than the lower end of partition plate 10, $H_2$ gas in the cathode chamber enters the anode chamber to form an explosive gas mixture which is liable to explode in the anode chamber.

Once explosion occurs, a part of an electrolytic cell destroyed and, in addition, hydrofluoric acid, a very corrosive chemical, is released and therefore, this probably results in a serious accident, and production of $NF_3$ will not be possible any more.

When clogging occurs at the outlet 12 of anode chamber, there is a danger similar to that as mentioned above. Further, when inlets for $N_2$ gas etc. are provided, the danger is the same as above if clogging occurs at the gas inlets. Therefore, such clogging is a big problem from the standpoints of safety and should be avoided without fail.

On the contrary, when the distance between lid 3 of the electrolytic cell and the liquid surface of electrolytic bath 4 is more than 500 mm, the volume between lid 3 of the electrolytic cell and the liquid surface of electrolytic bath 4 where $NF_3$ gas generated at anode and $H_2$ gas generated at cathode are present. Therefore, if a gas mixture of $NF_3$ and $N_2$ gases is formed by clogging or other cause and explosion etc. occurs by any possibility, the damage will be very big.

Consequently, in order to minimize damages such as explosion, such a type of electrolytic cell should be avoided.

When the distance between lid 3 of the electrolytic cell and the liquid surface of electrolytic bath 4 is more than 500 mm, the size of the electrolytic cell also becomes larger accordingly resulting in an excess investment and high cost.

In particular, the electrolytic bath is so hygroscopic that it inevitably absorbs moisture in air at the stage of preparing the starting materials. Therefore, upon producing $NF_3$, a dehydration electrolysis is essential which is effected by applying an electric current having a current density lower than that upon a main electrolysis, and after completion of dehydration electrolysis, the main electrolysis starts continuously.

The present inventors have found that when an electrolytic cell is too large, the dehydration electrolysis takes a long time and the dehydration efficiency is disadvantageously very low.

In an electrolytic cell for producing $NF_3$ gas by a molten salt electrolysis, usually a fluororesin plate is placed on the bottom plate of the electrolytic cell main body so as to inhibit corrosion of the bottom plate portion.

Also in the electrolytic cell of the present invention, fluororesin plate 2 is provided as shown in FIG. 1. In addition, for purposes of preventing corrosion of the electrolytic cell, it is preferable that a fluororesin is applied to parts contacting with molten salt and gases generated by electrolysis as well as the bottom plate part (by lining or coating) in the electrolytic cell.

The fluororesins as enumerated in the first aspect may be also used in the third aspect of the present invention.

According to the third aspect, $NF_3$ gas can be safely produced for a long period of time by a molten slat electrolysis by selecting a particular distance between the lid of the electrolytic cell and the liquid surface of the electrolytic bath. That is, clogging of inlets of a carrier gas into the electrolytic cell or outlets of gases generated in the both electrode chambers can be avoided by selecting the particular distance.

As a result, the danger of explosion caused by mixing of $NF_3$ gas and $H_2$ gas generated can be avoided and thereby $NF_3$ gas can be safely and continuously produced for a long period of time on an industrial scale.

Further, according to the present invention, two or three of the above-mentioned aspects may be used in combination.

For example, the second aspect or the third aspect is combined with the distance between the partition plate and the electrode as defined in the first aspect to constitute an electrolytic cell ; or the second aspect and the third aspect are combined to constitute an electrolytic cell.

Further, the present invention includes an electrolytic cell resulting from combining the first, second and third aspects, that is, an electrolytic cell for producing a nitrogen trifluoride gas by a molten salt electrolysis which comprises and electrolytic bath composed of a molten salt, an anode and a cathode soaked in the electrolytic bath such that the anode and the cathode are set substantially perpendicular to the bottom surface of the electrolytic cell, a lid fitted to the electrolytic cell for preventing evaporation of the electrolytic bath, and a partition plate separating the anode and the cathode, the distance between the anode and the partition plate and the distance between the cathode and the partition plate being in the range of 30 to 200 mm, the distance between the lower end of the anode and the bottom surface and that between the lower end of the cathode and the bottom surface being in the range of 30 to 300 mm, and the distance between the lid and the liquid surface of the electrolytic bath being in the range of 100 to 500 mm.

According to a further aspect of the present invention, there is provided an electrolytic cell for producing a nitrogen trifluoride gas by a molten salt electrolysis which comprises an anode, a cathode and a partition plate separating the anode and the cathode, the lower end of one of the anode and the cathode being situated lower than the lower end of the partition plate by 100–1000 mm while the lower end of the other being situated lower than the lower end of the partition plate by 100–2000 mm.

In addition, this aspect may be combined with at least one of the above-mentioned various aspects, that is, the particular range of the distance between the electrode and the partition plate, the particular range of the distance between the lower end of the electrode and the bottom surface of the electrolytic bath, and the particular range of the distance between the lid of the electrolytic cell and the liquid surface of the electrolytic bath.

As mentioned above, a further important point of the present invention is the longitudinal length of each of the electrodes in the electrolytic cell for producing $NF_3$ safely at a good electric current efficiency.

According to this aspect of the present invention, referring to the drawings attached hereto, the lower end of one of the electrodes, e.g. anode 5 and cathode 6 is situated 100–1000 mm lower than the lower end of partition plate 10 while the lower end of the other of the electrodes is situated 100–2000 mm lower than the lower end of partition plate 10. Therefore, as shown in FIG. 1, the lower ends of anode 5 and cathode 6 may be at the same distance in the vertical direction from the lower end of partition plate 10 within the range of 100–1000 mm. Further, as shown in FIG. 3, the lower ends of anode 5 and cathode 6 are located at different positions in the vertical direction as far as the positions relative to the lower end of partition plate 10 satisfy the above-mentioned limitation.

In addition, the lower end of anode 5 may be situated at a position in the vertical direction 100–1000 mm lower than the lower end of partition plate 10 while the lower end of cathode 6 may be situated at a position exceeding 1000 mm lower than the lower end of cathode 6.

Furthermore, the vertical positions of the lower ends of anode 5 and cathode 6 may be reversed.

As mentioned above, in the molten salt electrolysis of the present invention, only the portions of electrodes situated lower than the lower end of partition plate 10 function as electrodes, and as shown in FIG. 3, when the longitudinal lengths of anode 5 and cathode 6 are different from each other, no gas is generated at the region of the long electrode lower than the lower end of the short electrode (in FIG. 3, the region of cathode 6 vertically lower than the lower end of anode 5), that is, said region does not function as an electrode.

The electrolytic cell of the present invention has such a structure as mentioned above. When both positions of the lower ends of anode 5 and cathode 6 are exceeding 1000 mm lower than the lower end of partition plate 10, the distribution of electric current density in electrode becomes largely nonuniform and the electric current efficiency decreases to a great extent, and further $H_2$ gas generated at cathode 6 is liable to mix with $NF_3$ gas generated at anode 5 disadvantageously resulting in strong possibility of explosion.

On the contrary, when the positions of the lower ends of anode 5 and/or cathode 6 are situated lower than the lower end of partition plate 10 by less than 100 mm, the effective area of the electrode is not sufficient and therefore, such arrangement of electrode is not advantageous.

The invention is now particularly described with reference to the following examples which are for the purpose of illustration only and are intended to imply no limitation thereon.

EXAMPLE 1

Using a molten salt of a $NH_4F.HF$ system ($HF/NH_4F$, molar ratio, = 1.8) and an electrolytic cell as shown in FIG. 1 where the distance between partition plate 10 and each of anode 5 and cathode 6 was 40 mm, an electric current of 50 ampere (A) was applied to the electrolytic cell (average current density at anode being $2A/dm^2$) to start dehydration electrolysis.

The distance between the bottom surface of the cell and the lower end of each of the anode and the cathode was 150 mm, and the distance between the lid of the electrolytic cell and the liquid surface of the molten salt bath was 250 mm.

The concentration of oxygen in the gas generated at the anode was measured by gas chromatography. The concentration of oxygen decreased gradually and became constant, i.e. about 2 volume % (hereinafter, "volume %" is simply referred to a "%") after 100 hours. Therefore, it was recognized that dehydration electrolysis ended at this point.

After 100 hours at which dehydration was considered to have been finished, the electrolysis was transferred to a main electrolysis without interruption and the electrolysis was effected for a period of time as long as 3 months at 250 A (average current density of 10 $A/dm^2$ at anode) while the concentration of $H_2$ in the gas generated at anode and that of $NF_3$ in the gas generated at cathode were analyzed by gas chromatography. Each concentration was always at 1% or less and naturally no explosion occurred, and $NF_3$ was safely produced over a long period of time.

EXAMPLES 2–4

Following the procedure of Example 1 except that the distance between partition plate 10 and each of anode 5 and cathode 6 was as shown in Table 1, a dehydration electrolysis and a main electrolysis were carried out under the conditions as shown in Table 1 (the molten salt being the same as that in Example 1).

The time of completion of dehydration electrolysis was considered to be a time at which the concentration of oxygen in the gas generated at anode measured by gas chromatography decreased gradually and reached a constant value of about 2%. The time is shown in Table 1.

In a manner similar to Example 1, a long time continuous electrolysis was effected for 3 months while the concentration of $H_2$ in the gas generated at anode and that of $NF_3$ in the gas generated at cathode were analyzed by gas chromatography. Each concentration was always 1% or less and naturally no explosion occurred, and $NF_3$ was safely produced over a long period of time.

COMPARATIVE EXAMPLES 1–2

Repeating the procedure of Example 1 except that the distance between partition plate 10 and anode 5 and that between partition plate 10 and cathode 6 were as shown in Table 2 (one of the distances is outside of the numerical range of the present invention), dehydration electrolysis and a main electrolysis were carried out. The molten salt was the same as that used in Example 1.

The time of completion of dehydration electrolysis was considered a time at which the concentration of oxygen in the gas generated at anode measured by gas chromatography decreased gradually and reached a constant value of about 2%. And this time is shown in Table 2.

Then a main electrolysis was carried out in a manner similar to the procedure of Examples 1–4 in order to attain a three-month long continuous electrolysis while the concentration of $H_2$ in the gas generated at anode and that of $NF_3$ in the gas generated at cathode were analyzed by gas chromatography.

However, as shown in Table 2, after about one month, the concentration of $H_2$ in the gas generated at anode or that of $NF_3$ in the gas generated at cathode increased and came up close to the explosion limits. It was considered impossible to continue the electrolysis because of danger, and the electrolysis was immediately ceased.

COMPARATIVE EXAMPLES 3–4

Repeating the procedure of Example 1 except that the distance between partition plate 10 and anode 5 and that between partition plate 10 and cathode 6 were as shown in Table 3 (one of the distances is outside of the numerical range of the present invention), dehydration electrolysis and a main electrolysis were carried out. The molten salt was the same as that used in Example 1.

The time of completion of dehydration electrolysis was considered a time at which the concentration of oxygen in a gas generated at anode measured by gas chromatography decreased and reached a constant value of about 2%. The time is shown in Table 3. This shows that the time is much longer than that in Examples 1–4 and the efficiency is not good.

TABLE 1

| | Example 2 | Example 3 | Example 4 |
|---|---|---|---|
| Distance between anode and partition plate (mm) | 100 | 50 | 150 |
| Distance between cathode and partition plate (mm) | 100 | 150 | 50 |
| Time of completion of dehydration electrolysis (1) (hr) | 100 | 120 | 110 |
| Concentration of $H_2$ at anode (2) (%) | ≦1.0 | ≦1.0 | ≦1.0 |
| Concentration of $NF_3$ at cathode (2) (%) | ≦1.0 | ≦1.0 | ≦1.0 |

Note:
(1) A time at which the concentration of oxygen in the gas generated at anode measured by gas chromatography decreases gradually and reaches a constant value of about 2%.
(2) The concentration of $H_2$ in the gas generated at anode and that of $NF_3$ in the gas generated at cathode determined by gas chromatography after 3 months of the main electrolysis.

TABLE 2

| | Comparative Example 1 | Comparative Example 2 |
|---|---|---|
| Distance between anode and partition plate (mm) | 15 | 100 |
| Distance between cathode and partition plate (mm) | 100 | 15 |
| Time of completion of dehydration electrolysis (1) (hr) | 100 | 100 |
| Concentration of $H_2$ at anode (2) (%) | ≦1.0 | 5.0 |
| Concentration of $NF_3$ at cathode (2) (%) | 5.0 | ≦1.0 |

Note:
(1) A time at which the concentration of oxygen in the gas generated at anode measured by gas chromatography decreases gradually and reaches a constant value of about 2%.
(2) The concentration of $H_2$ in the gas generated at anode and that of $NF_3$ in the gas generated at cathode determined by gas chromatography after 1 month of the main electrolysis.

TABLE 3

| | Comparative Example 3 | Comparative Example 4 |
|---|---|---|
| Distance between anode and partition plate (mm) | 250 | 100 |
| Distance between cathode and partition plate (mm) | 100 | 250 |
| Time of completion of dehydration electrolysis (1) (hr) | 250 | 300 |

Note:
(1) A time at which the concentration of oxygen in the gas generated at anode measured by gas chromatography decreases gradually and reaches a constant value of about 2%.

EXAMPLE 5

Using a molten salt of a $NH_4F.HF$ system ($HF/NH_4F$, molar ratio, = 1.8) and an electrolytic cell as shown in FIG. 3 where the distance between the lower end of anode 5 and the bottom surface of the electrolytic cell (fluororesin plate 2) and that between the lower end of cathode 6 and the bottom surface were both 40 mm, an electric current of 50 ampere (A) was applied to the electrolytic cell (average current density at anode being 2 A/dm$^2$) to start dehydration electrolysis at 120° C.

The distance between the partition plate and each of the anode and the cathode was 150 mm and the distance between the lid of the electrolytic cell and the liquid surface was 250 mm.

The concentration of oxygen in the gas generated at anode was analyzed by gas chromatography. The concentration gradually decreased and, after 80 hours, became constant at about 2%. It was considered that the dehydration electrolysis ended at this time.

After 80 hours when the dehydration was considered to end, a main electrolysis was carried out continuously, and a long continuous electrolysis was effected at 250 A (average electric current density of 10 A/dm$^2$ at anode) while the voltage and temperature distribution in the electrolytic cell and the electric current efficiency for producing $NF_3$ gas were monitored.

The voltage in the electrolytic cell was less than 8V, the temperature distribution in the electrolytic cell was within the range of 120° to 125° C. and the electric current efficiency of producing $NF_3$ gas was a normal value, that is, 65%, naturally there was no danger of explosion and $NF_3$ was produced safely in good yield over a long period of time.

EXAMPLES 6–8

Repeating the procedure of Example 5 except that the distance between the bottom surface of the electrolytic cell (fluororesin plate 2) and each of the lower end of anode 5 and that of cathode 6 was as shown in Table 4. dehydration electrolysis and a main electrolysis were effected under the conditions in Table 4 (The molten salt being the same as that used in Example 5.).

The time at which the dehydration electrolysis was considered to be completed, i.e. a time when the concentration of oxygen in the gas generated at anode measured by gas chromatography decreased gradually and reached a constant value of about 2%, was as shown in Table 4.

In a matter similar to example 5, a three-month long continuous electrolysis was effected while the voltage and temperature distribution in the electrolytic cell and the electric current efficiency of $NF_3$ gas generation were monitored. The voltage of electrolytic cell was less than 8V, the temperature distribution in the electrolytic cell was kept within the range of 120° to 125° C. and the electric current efficiency of producing $NF_3$ gas was a normal value i.e. 65%.

Naturally $NF_3$ was safely produced for a long period of time without any danger of explosion.

COMPARATIVE EXAMPLES 5–6

Repeating the procedure of Example 5 except that the distance between the bottom surface of the electrolytic cell (fluororesin plate 2) and the lower end of anode 5 and that between the bottom surface and the lower end of cathode 6 was as shown in Table 5 (one of the distances is outside of the numerical range of the present invention), dehydration electrolysis and the main electrolysis were effected (the molten salt being the same as that in Example 5.).

The time at which the dehydration electrolysis was considered to be completed, i.e. a time when the concentration of oxygen in the gas generated at anode measured by gas chromatography decreased gradually and reached a constant value of about 2%, was as shown in Table 5.

Then, a main electrolysis was carried out in a manner similar to examples 5–8, in order to attain a three-month long continuous electrolysis while the voltage and the temperature distribution in the electrolytic cell and the electric current efficiency for producing $NF_3$ gas were monitored.

As a result, as shown in Table 5, after about one month, the voltage of the electrolytic cell exceeded 8V, the temperature distribution in the electrolytic cell exceeded 130° C. and the electric current efficiency for producing $NF_3$ gas became less than 50%. In view of the abnormal situations, it was recognized impossible to carry out the electrolysis any more and the electrolysis was immediately ceased.

COMPARATIVE EXAMPLES 7–8

Repeating the procedure of Example 5 except that the distance between the bottom surface of the electrolytic cell (fluororesin plate 2) and the lower end of anode 5 and that between the bottom surface and the lower end of cathode 6 was as shown in Table 6 (outside of the numerical range of the present invention), dehydration electrolysis and the main electrolysis were effected (the molten salt being the same as that used in Example 5.).

The time at which the dehydration electrolysis was considered to be completed, i.e. a time when the concentration of oxygen in the gas generated at anode measured by gas chromatography decreased gradually and reached a constant value of about 2%, was as shown in Table 6. This indicates that it took a much longer time than the time in Examples 5–8 and therefore the dehydration efficiency was poor.

TABLE 4

| | Example 6 | Example 7 | Example 8 |
|---|---|---|---|
| Distance between lower end of anode and bottom surface of electrolytic cell (mm) | 200 | 50 | 250 |
| Distance between lower end of cathode and bottom surface of electrolytic cell (mm) | 200 | 250 | 50 |
| Time of completion of dehydration electrolysis (1) (hr) | 100 | 120 | 120 |
| Electrolytic cell voltage (2) (V) | 7.7 | 7.5 | 7.8 |
| Temperature distribution in electrolytic cell (2) (°C.) | 120–125 | 120–125 | 120–125 |
| Electric current efficiency of $NF_3$ production (2) (%) | 65 | 65 | 65 |

Note:
(1) A time at which the concentration of oxygen in the gas generated at anode measured by gas chromatography decreases gradually and reaches a constant value of about 2%.
(2) Values after 3 months of the main electrolysis.

TABLE 5

| | Comparative Example 5 | Comparative Example 6 |
|---|---|---|
| Distance between lower end of anode and bottom surface of electrolytic cell (mm) | 15 | 100 |
| Distance between lower end of cathode and bottom surface of electrolytic cell (mm) | 100 | 15 |
| Time of completion of dehydration electrolysis (1) (hr) | 100 | 100 |
| Electrolytic cell voltage (2) (V) | 8.1 | 8.3 |
| Temperature distribution in electrolytic cell (2) (°C.) | 120–135 | 120–135 |
| Electric current efficiency | 45 | 48 |

TABLE 5-continued

| | Comparative Example 5 | Comparative Example 6 |
|---|---|---|
| of $NF_3$ production (2) (%) | | |

Note:
(1) A time at which the concentration of oxygen in the gas generated at anode measured by gas chromatography decreases gradually and reaches a constant value of about 2%.
(2) Values after one month of the main electrolysis.

TABLE 6

| | Comparative Example 7 | Comparative Example 8 |
|---|---|---|
| Distance between lower end of anode and bottom surface of electrolytic cell (mm) | 100 | 400 |
| Distance between lower end of cathode and bottom surface of electrolytic cell (mm) | 400 | 100 |
| Time of completion of dehydration electrolysis (1) (hr) | 250 | 300 |

Note:
(1) A time at which the concentration of oxygen in the gas generated at anode measured by gas chromatography decreases gradually and reaches a constant value of about 2%.

EXAMPLE 9

Using a molten salt of $NH_4F.HF$ system ($HF/NH_4F$, molar ratio, = 1.8) and an electrolytic cell where the distance between lid 3 of the electrolytic cell and the liquid surface of electrolytic bath 4 was 150 mm as illustrated in FIG. 1, an electric current was applied at 50 ampere (A) (average electric current density of 2 $A/dm^2$ at anode) to start dehydration electrolysis at 120° C. The distance between the partition plate and each of the anode and the cathode was 150 mm, and the distance between the bottom surface of the electrolytic cell and each of the lower end of the anode and that of the cathode was 150 mm.

The concentration of oxygen in the gas generated at anode was analyzed by gas chromatography. The concentration of oxygen gradually decreased and after 80 hours of dehydration electrolysis, became constant at about 2%. It was considered that dehydration electrolysis ended at this time.

After 80 hours when dehydration electrolysis was considered to end, the electrolysis was continuously transferred to a main electrolysis and a three-month long continuous electrolysis was carried out while the amount of flowing gas generated at anode and that at cathode were monitored and it was observed based on change with time whether clogging occurred. However, no change was found at both electrodes, and naturally no explosion occurred. Thus, $NF_3$ was produced safely over a long period of time.

EXAMPLE 10

Repeating the procedure of Example 9 except that the distance between lid 3 of the electrolytic cell and the liquid surface of electrolytic bath 4 was 400 mm, dehydration electrolysis and a main electrolysis were effected (the molten salt was the same as that in Example 9).

The time when the concentration of oxygen in the gas generated at anode measured by gas chromatography gradually decreased and reached a constant value of about 2%, at which dehydration electrolysis was considered to end, was 100 hours. This time was somewhat longer than that in Example 9. In a way similar to Example 9, a three-month long continuous electrolysis was carried out while amounts of flowing gases generated at anode and cathode were monitored and it was observed based on change with time whether clogging occurred. No change was found at both electrodes, and naturally no explosion occurred and $NF_3$ was safely produced over a long period of time.

COMPARATIVE EXAMPLE 9

Repeating the procedure of Example 9 except that the distance between lid 3 of the electrolytic cell and the liquid surface of electrolytic bath 4 was 50 mm (outside of the numerical range of the present invention), dehydration electrolysis and a main electrolysis were carried out. The molten salt was the same as that in Example 9).

The time when the concentration of oxygen in the gas generated at anode measured by gas chromatography gradually decreased and reached a constant value of about 2%, at which dehydration electrolysis was considered to end, was 80 hours. This time was the same as that in Example 9.

However, when a main electrolysis was then effected in a manner similar to Examples 9–10 to attain a three-month long continuous electrolysis while amounts of flowing gases generated at anode and cathode were monitored and it was observed on the bases of change with time whether clogging occurred at gas outlets, the amount of flowing gas generated at anode abruptly decreased down to almost zero after about one week. Electrolysis was stopped and outlet 12 for gas generated at anode was observed and it was found that $NH_4F.HF$ deposited to clog the outlet 12, and it was also found that $NH_4F.HF$ deposited outlet 13 for gas generated at cathode. This fact threatened a complete clog soon. Thus it was found that a long time operation was not possible unlike Examples 9 and 10.

Further, when the distance between lid 3 of the electrolytic cell and the liquid surface of electrolytic bath 4 is larger than 500 mm (outside of the numerical range of the present invention), it is clear from Example 10 that there is no danger. Therefore, any research was not made.

In the following, the term "average electric current density" means "an electric current value divided by the surface area of the portion of an electrode situated lower than the lower end of the partition plate" (However, when the lengths in the vertical direction of an anode and a cathode are different from each other as illustrated in FIG. 3, the "surface area" is that of the shorter electrode.)

This value of the "average electric current density" is given on the assumption that the electric current density is uniform over the all region, but does not have a nonuniform electric current density distribution.

The "%" in the following is "% by volume" unless otherwise specified.

EXAMPLE 11

Using a molten salt of a $NH_4F.HF$ system ($HF/NH_4F$, molar ratio = 1.8) and an electrolytic cell as illustrated in FIG. 1 where the lower ends of anode 5 and cathode 6 are 500 mm lower than the lower end of partition plate 10, an electric current of 50 ampere (A) was applied to the electrolytic cell (average current density being 2.0 A/dm$^2$) to start dehydration electrolysis. After one hour of dehydration electrolysis, concentrations of $H_2$ and $OF_2$ in the gas generated at anode were analyzed by gas chromatography and found to be 2.7% and 1.2%, respectively, and dehydration electrolysis could be safely carried out without explosion.

After 200 hours at which dehydration was considered to have been finished, the electrolysis was transferred to a main electrolysis without interruption and the main electrolysis was effected for 200 hours at 250 A (average current density of 10.0 A/dm$^2$) and no explosion occurred.

The electric current efficiency was calculated from the amount of $NF_3$ gas generated by the electrolysis and the applied electric power and found to be as high as 65%.

EXAMPLES 12–14

The procedure of Example 11 was repeated to effect a dehydration electrolysis and a main electrolysis except that the lower ends of anode 5 and cathode 6 were lower than the lower end of partition plate 10 by the lengths as shown in Table 7 and electrolysis conditions in Table 7 were adopted. (The molten salt was the same as that in Example 11.)

After one hour of the dehydration electrolysis, the concentrations of $H_2$ and $OF_2$ in the gas generated at the anode were as shown in Table 7, and no explosion occurred as in Example 11.

After 200 hours of dehydration electrolysis, a main electrolysis was subsequently carried out under the conditions as shown in Table 7 for 200 hours.

The results are shown in Table 7. The values of electric current efficiency are satisfactory. No explosion occurred and $NF_3$ was safely produced.

COMPARATIVE EXAMPLES 10–12

The procedure of Example 11 was repeated to effect dehydration electrolysis except that the conditions as shown in Table 8 were adopted, in particular, the lower ends of anode 5 and cathode 6 are lower than the lower end of partition plate 10 by a length not within the scope of the present invention. However, explosion sound occurred shortly in the electrolytic cell and therefore, the electrolysis was stopped immediately since it was judged that no further continuation of the electrolysis was possible.

TABLE 7

| | | | Example 11 | Example 12 | Example 13 | Example 14 |
|---|---|---|---|---|---|---|
| Length of anode from the lower end of partition plate (mm) *1 | | | 500 | 1000 | 1200 | 1000 |
| Length of cathode from the lower end of partition plate (mm) *1 | | | 500 | 1000 | 1000 | 1500 |
| Dehydration electro- | Electric current(A) | | 50 | 100 | 120 | 100 |
| | Average current | Anode | 2.0 | 2.0 | 2.0 | 2.0 |
| | | Cathode | 2.0 | 2.0 | 2.4 | 1.3 |

TABLE 7-continued

| | | Example 11 | Example 12 | Example 13 | Example 14 |
|---|---|---|---|---|---|
| lysis | density ($A/dm^2$) | | | | |
| | $H_2$ concentration (%)*2 | 2.7 | 3.7 | 4.0 | 3.5 |
| | $OF_2$ concentration (%)*2 | 1.2 | 1.6 | 1.8 | 1.6 |
| Main electro-lysis | Electric current(A) | 250 | 500 | 600 | 500 |
| | Average current density ($A/dm^2$) Anode | 10.0 | 10.0 | 10.0 | 10.0 |
| | Cathode | 10.0 | 10.0 | 12.0 | 6.5 |
| | Electric current efficiency (%) | 65 | 66 | 64 | 65 |

*1 The distance between the lower end of anode or cathode and the position on the anode or cathode corresponding to the lower end of the partition plate.
*2 $H_2$ gas concentration and $OF_2$ gas concentration are those in a gas generated at anode after one hour of dehydrogenation electrolysis.

TABLE 8

| | | Comparative Example 10 | Comparative Example 11 | Comparative Example 12 |
|---|---|---|---|---|
| Length of anode from the the lower end of partition plate (mm) *1 | | 1200 | 1500 | 1200 |
| Length of cathode from the lower end of partition plate (mm) *1 | | 1200 | 1200 | 1500 |
| Electric current (A) | | 120 | 150 | 120 |
| Average electric current density ($A/dm^2$) | Anode | 2.0 | 2.0 | 2.0 |
| | Cathode | 2.0 | 2.6 | 1.6 |
| Remarks | | Explosion after 10 min. | Explosion after 5 min. | Explosion after 15 min. |

*1 The distance between the lower end of anode or cathode and the position on the anode or cathode corresponding to the lower end of the partition plate.

What is claimed is:

1. An electrolytic cell for producing a nitrogen trifluoride gas by a molten $NH_4F$-HF or KF-$NH_4F$-HF salt electrolysis which comprises a nickel anode, a nickel cathode and a partition plate separating the nickel anode and the nickel cathode, the lower end of one of the nickel anode and the nickel cathode being situated lower than the lower end of the partition plate by 100 to 1000 mm with the lower end of the other of the nickel anode or nickel cathode being situated lower than the lower end of the partition plate by 100 to 2000 mm.

2. An electrolytic cell for producing a nitrogen trifluoride gas by a molten $NH_4F$-HF or KF-$NH_4F$-HF salt electrolysis which comprises a nickel anode, a nickel cathode and a partition plate separating the nickel anode and the nickel cathode, the lower end of one of the nickel anode and the nickel cathode being situated lower than the lower end of the partition plate by 100 to 1000 mm with the lower end of the other of the nickel anode or nickel cathode being situated lower than the lower end of the partition plate by 100 to 2000 mm, and the distance between the nickel anode and the partition plate and the distance between the nickel cathode and the partition plate each being in the range of 30 to 300 mm.

3. An electrolytic cell according to claim 2 wherein said nickel anode and nickel cathode are set substantially perpendicular to the bottom surface of the electrolytic cell, and the distance between the lower end of the nickel anode and the bottom surface and that between the lower end of the nickel cathode and the bottom surface each are in the range of 30 to 200 mm.

4. An electrolytic cell according to claim 2 wherein additionally a lid is fitted to the electrolytic cell for preventing evaporation of the electrolytic bath, the distance between the lid and the liquid surface of the electrolytic bath being adapted to be in the range of 100 to 500 mm.

5. An electrolytic cell for producing a nitrogen trifluoride gas by a molten $NH_4F$-HF or KF-$NH_4F$-HF salt electrolysis bath which comprises a nickel anode and a nickel cathode adapted to be in contact with said electrolytic bath such that the nickel anode and the nickel cathode are set substantially perpendicular to the bottom surface of the electrolytic cell, the distance between the lower end of the nickel anode and the bottom surface and the distance between the lower end of the nickel cathode and the bottom surface each being in the range of 30 to 300 mm, and the lower end of one of the nickel anode and the nickel cathode being situated lower than the lower end of the partition plate by 100 to 1000 mm with the lower end of the other of the nickel anode or nickel cathode being situated lower than the lower end of the partition plate by 100 to 2000 mm.

6. An electrolytic cell for producing a nitrogen trifluoride gas by a molten $NH_4F$-HF or KF-$NH_4F$-HF salt electrolysis bath which comprises a nickel anode and a nickel cathode adapted to be in contact with said electrolytic bath, and a lid fitted to the electrolytic cell for preventing evaporation of the electrolytic bath, the distance between the lid and the liquid surface of the electrolytic bath being adapted to be in the range of 100 to 500 mm, and the lower end of one of the nickel anode and the nickel cathode being situated lower than the lower end of the partition plate by 100 to 1000 mm with the lower end of the other of the nickel anode or nickel cathode being situated lower than the lower end of the partition plate by 100 to 2000 mm.

* * * * *